US006719531B2

(12) United States Patent
Wu

(10) Patent No.: US 6,719,531 B2
(45) Date of Patent: Apr. 13, 2004

(54) CEILING FAN BLADE FOR QUICK ASSEMBLY

(76) Inventor: Wen-Chang Wu, No. 10, Lane 191, Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 11 days.

(21) Appl. No.: 10/294,660

(22) Filed: Nov. 15, 2002

(65) Prior Publication Data

US 2004/0037702 A1 Feb. 26, 2004

(30) Foreign Application Priority Data

Aug. 26, 2002 (TW) ..... 91213259 U

(51) Int. Cl.[7] ..... F04D 29/36

(52) U.S. Cl. ..... 416/206; 416/210 R; 416/220 A; 416/221; 403/322.1; 403/324; 403/325; 403/327; 403/328

(58) Field of Search ..... 416/5, 204 R, 416/205, 206, 207, 208, 209, 210 R, 220 A, 221; 403/321, 322.1, 322.3, 324, 325, 327, 328

(56) References Cited

U.S. PATENT DOCUMENTS

| | | | | | |
|---|---|---|---|---|---|
| 324,671 | A | * | 8/1885 | Drake | 403/325 |
| 2,712,151 | A | * | 7/1955 | Becht | 403/325 |
| 2,902,065 | A | * | 9/1959 | Graves | 403/325 |
| 4,396,352 | A | * | 8/1983 | Pearce | 416/206 |
| 5,180,284 | A | * | 1/1993 | Monrose, III et al. | 416/206 |
| 5,980,353 | A | * | 11/1999 | Wu | 416/210 R |
| 6,010,306 | A | * | 1/2000 | Bucher et al. | 416/210 R |
| 6,027,310 | A | * | 2/2000 | Kerr et al. | 416/210 R |
| 6,059,531 | A | * | 5/2000 | Tai | 416/220 A |
| 6,378,824 | B1 | * | 4/2002 | Tseng | 416/210 R |
| 6,390,777 | B1 | * | 5/2002 | Kerr, Jr. | 416/204 R |
| 2004/0001758 | A1 | * | 1/2004 | Liang | 416/221 |

* cited by examiner

*Primary Examiner*—Christopher Verdier
(74) *Attorney, Agent, or Firm*—Troxell Law Office PLLC

(57) ABSTRACT

A ceiling fan blade with quick assembly comprises a connector disposed below a disc of the ceiling fan, and a blade holder coupled to the connector, in which the connector has an embedded hole at the end of its insert rod; a blocking groove on the vertical surface of the connector; a spring and a convex insert member are placed in advance, and a blade holder forming an accommodating groove at an end proximate to the connector for receiving the insert rod, and the accommodating groove has a blocking member corresponsive to the embedding hole of the insert rod. By means of pushing the insert rod of the connector into the accommodating groove of the blade holder, the protruded member of connector is exactly blocked by the transversal isolating plate and compresses the spring inward. Then, the embedding member can be latched into the embedding hole, such that the end of the insert rod of the connector can be fully embedded into the accommodating groove of the blade holder, and the protruded member by means of its resilent force is inserted into the embedding groove of the blade holder. Such arrangement enables the connector and the blade holder to be embedded or removed quickly and easily in order to facilitate the disassembly for cleaning and reduce the volume for storage and transportation as well as lower the transportation cost.

1 Claim, 4 Drawing Sheets

CEILING FAN BLADE FOR QUICK ASSEMBLY

BACKGROUND OF THE INVENTION

1. Field of the Invention

A ceiling fan blade for quick assembly makes use of a spring and an embedded convex member placed into an insert rod of a connector in advance; an accommodating groove for accommodating the insert rod disposed at the end proximate to the connector of a blade holder; an embedded blocking member on the accommodating groove corresponsive to an embedded hole of the insert rod; by means of pushing the insert rod of the connector into the accommodating groove of the blade holder, the connector and the blade holder can be installed or removed quickly and easily in order to facilitate the disassembly and reduce the volume for storage and transportation as well as lower the transportation cost.

2. Description of the Related Art

The conventional ceiling fan blade structure is generally in the form of an integral structure of the fixed blades with the blade holder, with one of its ends fixed to the bottom of the disc of the ceiling fan, and the other end to the blade in order to fix the blade into the position on the disc. However, such blade structure is an integral piece, and both of its ends are coupled to the disc and the blade respectively, and thus when we want to remove the blade for cleaning, we need to unscrew the blade from the blade holder. Since the blade and blade holder are fixed for balancing the rotation of the blades (the rotation of the blade will generate a swing if there is an deviated angle), therefore the angle of fixing both sides of the blade holder is adjusted in advance. If the blade is removed from the blade holder and then reinstalled at will, it may cause a deviated angle if we fix the screw too tight or too loose, and may cause the risk of having the swinging blades during the rotation. It also makes the removal of the blade for cleaning uneasy. Furthermore, since the traditional blade of the ceiling fan is an integral piece, it takes more space for its assembling and transportation, and thus increases the cost.

In view of the aforementioned shortcomings, the inventor of the present invention based on years of experience accumulated from the engagement in the related industry conducted extensive research to resolve the aforementioned shortcomings and invented the present invention "Ceiling fan blade for quick assembly" with better performance.

SUMMARY OF THE INVENTION

The primary objective of the present invention is to provide a ceiling fan blade for quick assembly, comprising a connector disposed below a disc of the ceiling fan, and a blade holder coupled to the connector, in which the connector has an embedded hole at the end of its insert rod; a blocking groove on the vertical surface of the connector; a spring and a convex insert member are placed in advance, and a blade holder forming an accommodating groove at an end proximate to the connector for receiving the insert rod, and the accommodating groove has a blocking member corresponsive to the embedded hole of the insert rod. By means of pushing the insert rod of the connector into the accommodating groove of the blade holder, the protruded member of the connector is exactly blocked by the transversal isolating plate and compresses the spring inward. Then, the embedding member can be latched into the embedded hole, such that the end of the insert rod of the connector can be fully embedded into the accommodating groove of the blade holder, and the protruded member by means of its resilent force is inserted into the embedding groove of the blade holder. Such arrangement enables the connector and the blade holder to be embedded or removed quickly and easily in order to facilitate the disassembly for cleaning and reduce the volume for storage and transportation as well as lower the transportation cost.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENTS

Figure 1:
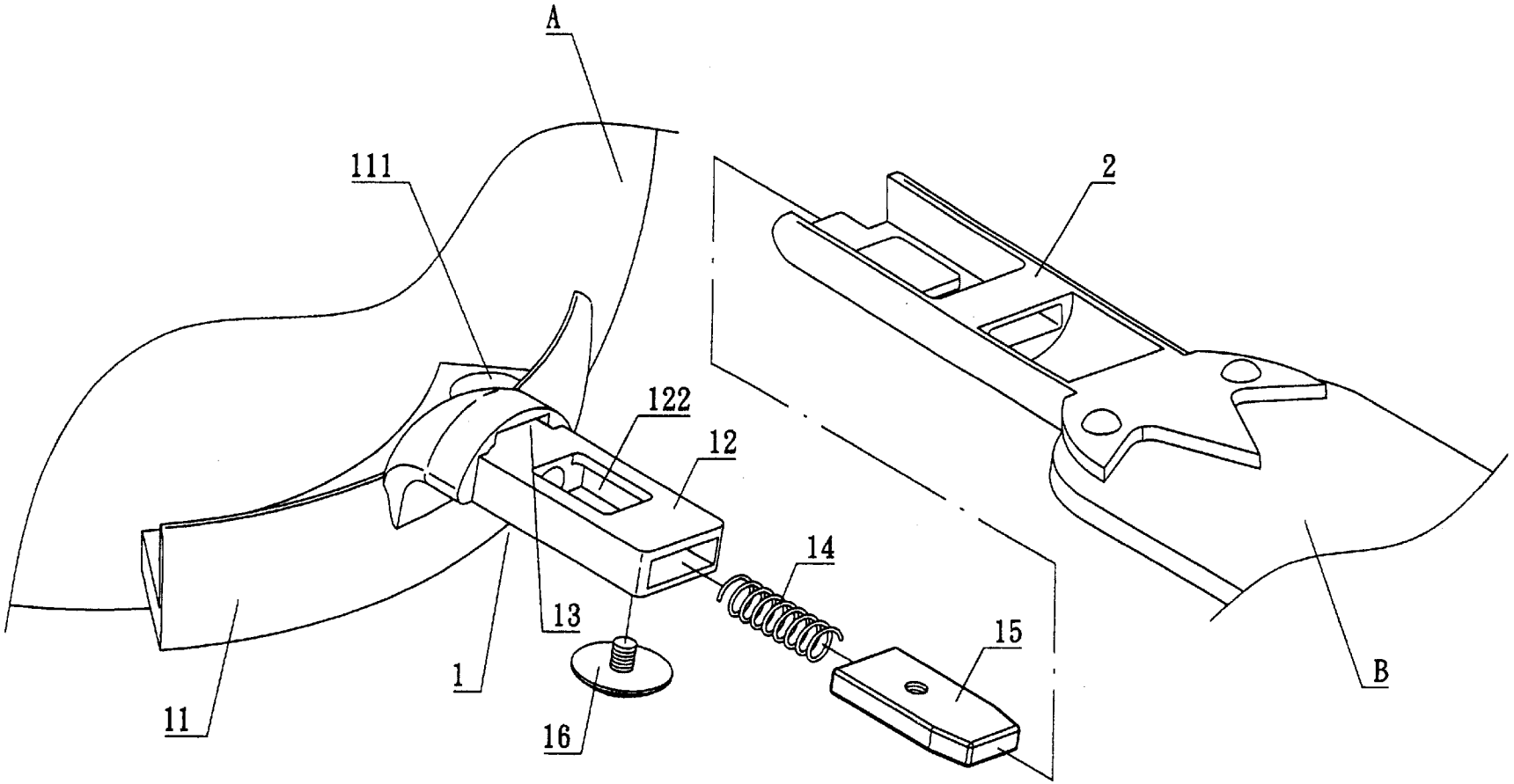
FIG. 1 is an explosive diagram of the present invention.
Figure 2:
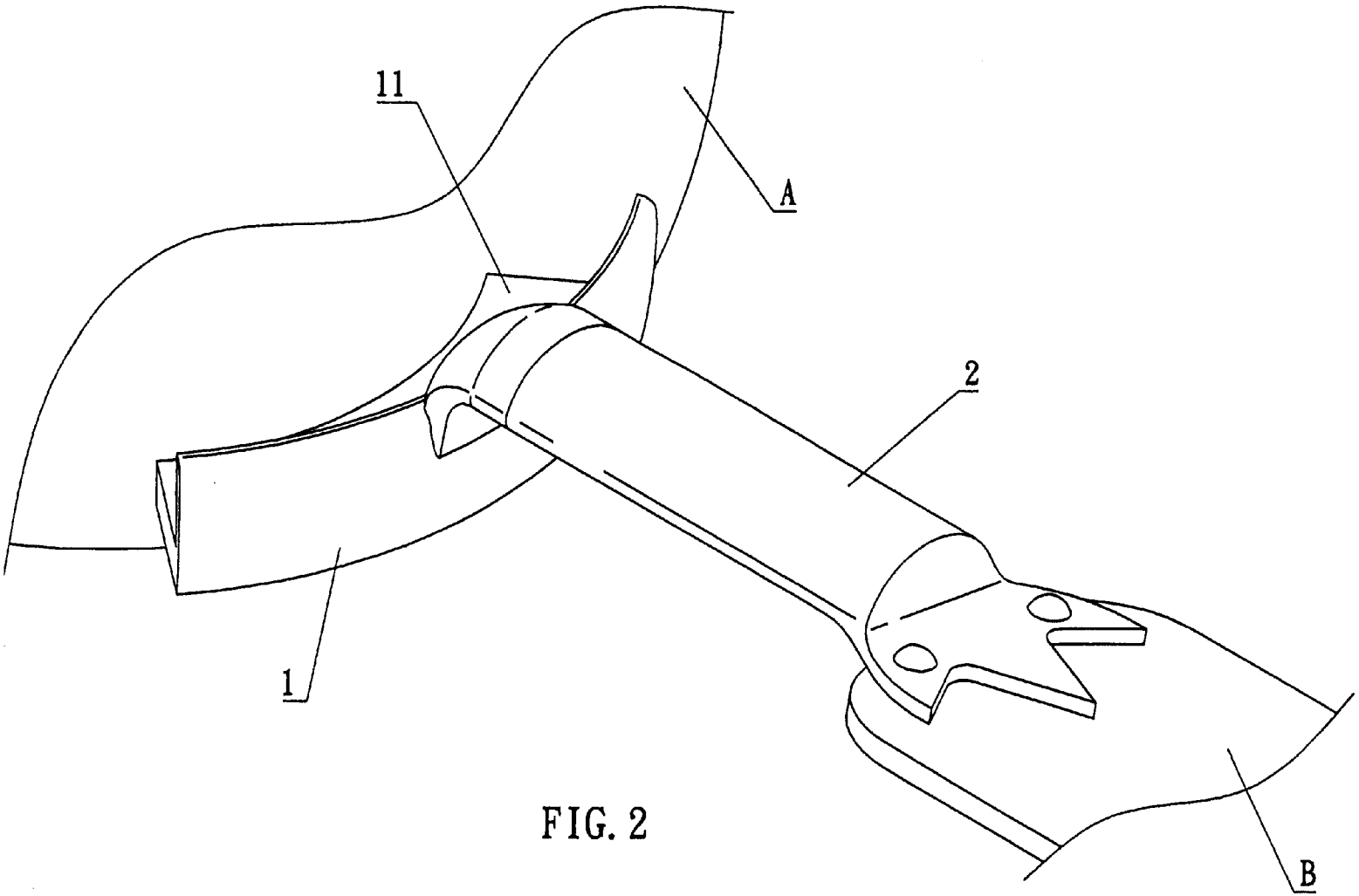
FIG. 2 is an assembled diagram of the present invention.

Please refer to FIGS. 1 and 2 for a clear understanding of the structure and mode of the present invention. The ceiling fan blade of the present invention comprises a connector 1 disposed below a disc A of the ceiling fan, and a blade holder 2 coupled to the connector with one of its end and coupled to a blade B with another end, wherein: the connector 1 further comprising a circular connecting plate 11; a connecting hole 111 disposed on both sides of the connecting plate 11 for coupling the disc A of the ceiling fan; a hollow insert rod 12 is disposed at an end of the connector 1; a positioning hole 121 disposed at the bottom of the insert rod 12; an embedded hole 122 at the top of the insert rod 12; a blocking groove 13 disposed on the vertical surface of the connector at the position where the insert rod 12 and the connector 1 are coupled; a spring 14 being placed inside the insert rod 12 in advance, and a protruded member 15 is coupled immediately after the end of the spring 14 that slightly protrudes from the external end of the insert rod 12, and the bottom of such protruded member 15 is fixed to an adjusting button 16 on the outer side of the positioning hole 121 such that the adjusting button 16 will drive the protruded member 15 to move simultaneously; the blade holder 2 is a rod structure with a hollow section at its top end, and the middle section of the hollow section is partitioned into halves by a transversal isolating plate 21, and such isolating plate passes through the hollow sections and is available for inserting the protruded member 15 into the embedding groove 22 such that the blade holder 2 presses against an end of the connector 1 to form an insert member 231 corresponsive to the blocking groove 13 of the connector, and the accommodating groove 23 has an embedded member 232 corresponsive to the embedded hole 122 of the insert rod.

Please refer to FIG. 3 for the movement of inserting the blade holder into the connector. When the connector 1 and the blade holder are connected, the insert rod 12 of the connector 1 is aligned with the accommodating groove 23 of the blade holder such that the insert member 231 of the blade holder 2 is aligned with the blocking groove 13 of the connector 1. Then the protruded member 15 of the connector 1 presses against the transversal isolating plate 21 of the blade holder 2 (as shown in FIG. 3A).

Figure 3A:
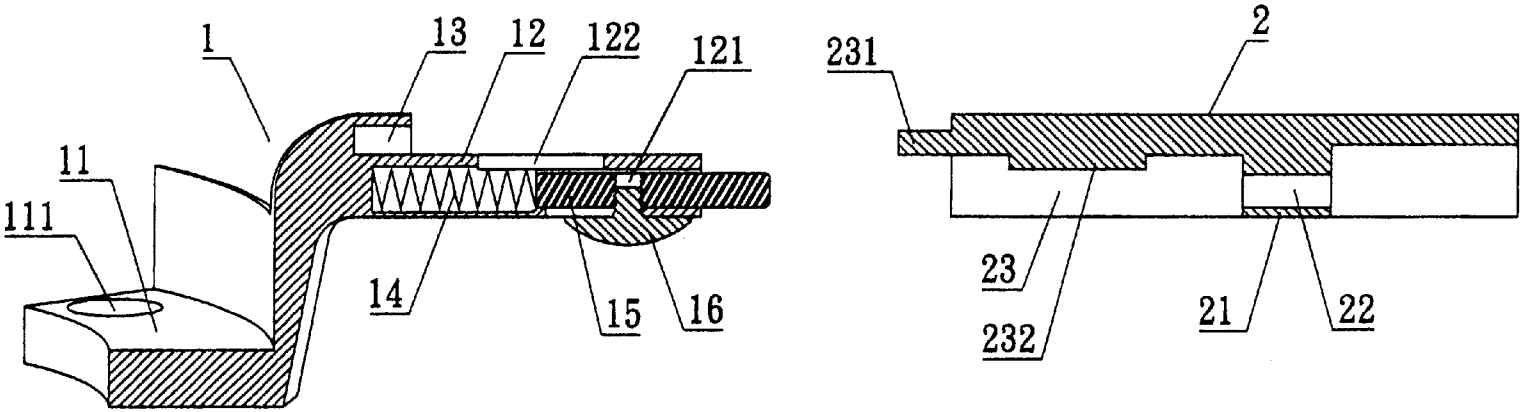
FIG. 3A is an illustrative diagram of the movement of a preferred embodiment of the present invention before the insertion of the blade holder and the connector.
Figure 3B:
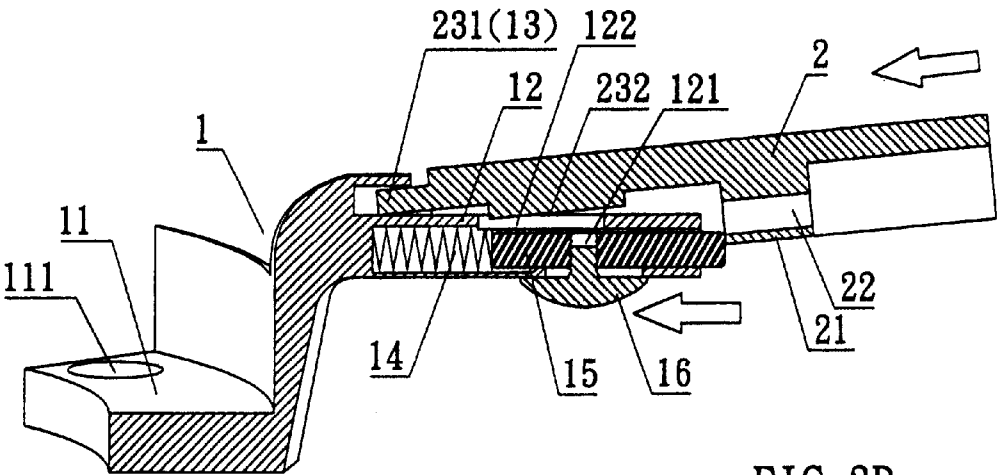
FIG. 3B is an illustrative diagram of the movement of a preferred embodiment of the present invention during the insertion of the blade holder into the connector.

By means of pushing the connector 1 and the blade holder 2, the protruded member 15 of the connector is exactly blocked by the transversal isolating plate 21 to press the spring 14 inward (as shown in FIG. 3B).

Figure 3C:
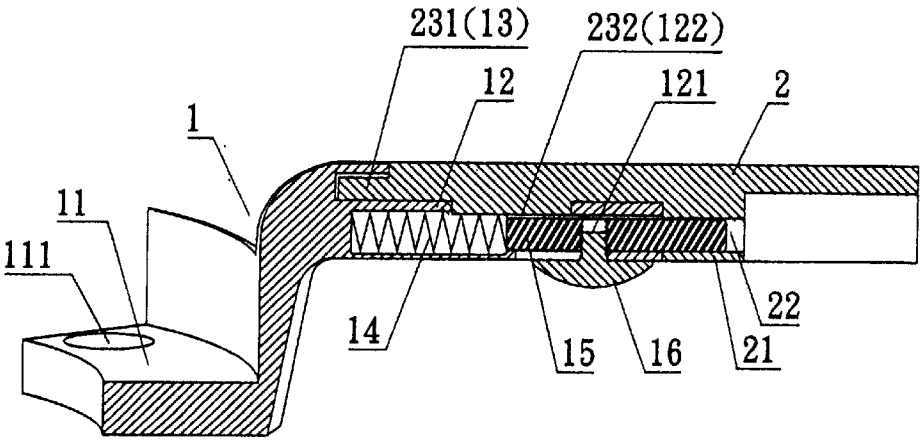
FIG. 3C is an illustrative diagram of the movement of a preferred embodiment of the present invention after the insertion of the blade holder and the connector.

When the embedded member 232 of the blade holder 2 is exactly aligned with the embedding hole 122 of the connector 1, the embedded member 232 can be latched exactly into the embedding hole, such that the end of the insert rod 12 of the connector 1 can be fully embedded into the accommodating groove 23 of the blade holder 2, and then the protruded member 15 of the connector 1 is aligned exactly on the embedding groove 22 of the transversal isolating plate 21. The protruded member 15 by means of its resilent force is pushed into the embedding groove 22 of the blade holder 2 (as shown in FIG. 3C).

Figure 3D:
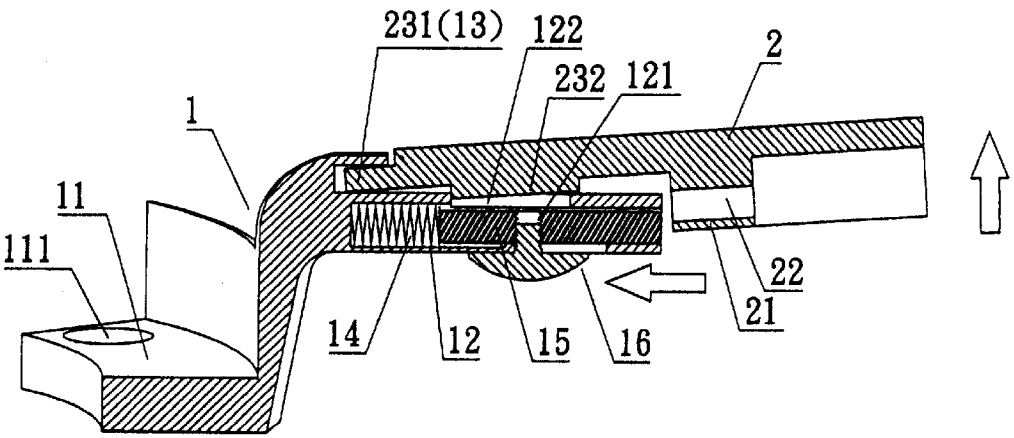
FIG. 3D is an illustrative diagram of the movement of a preferred embodiment of the present invention during the removal of the blade holder from the connector.

When the user wants to remove the blade holder from the connector, the user may push adjusting button 16 forward at the bottom of the protruded member 15, so that the adjusting button 16 will drive the protruded member to move at the same time, and compress the spring 14 again to separate the protruded member 15 of the connector 1 from the embedding groove 22 of the blade holder 2. In addition, the connector 1 and the blade holder 2 can be separated in an opposite direction in order to provide the separation of the insert rod 12 of the connector 1 and the latching of the embedding groove of the blade holder 2 (as shown in FIG. 3D).

Such arrangement enables the connector and the blade holder to be embedded or removed quickly and easily in order to facilitate the disassembly for cleaning and reduce the volume for storage and transportation as well as lower the transportation cost.

In summation of the above description, the present invention herein enhances the performance than the conventional structure and further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A ceiling fan blade for quick assembly, comprising a connector at the bottom of a disc of a ceiling fan and a blade holder coupled to the connector; wherein:

the connector further comprising a circular connecting plate at one of its ends; a connecting hole, disposed on both sides of the connecting plate for coupling the disc of the ceiling fan; a hollow insert rod, disposed at an end of the connector; a positioning hole, disposed at the bottom of the insert rod; an embedded hole at the top of the insert rod; a blocking groove disposed on the vertical surface of the connector at the position where the insert rod and the connector are coupled; a spring, placed inside the insert rod in advance, and a protruded member, coupled immediately after the end of the spring that slightly protrudes from the external end of the insert rod, and the bottom of such protruded member being fixed to an adjusting button on the outer side of the positioning hole such that the adjusting button drives the protruded member to move at the same time;

the blade holder, being a rod structure with a hollow section at its top end, and the middle section of the hollow section being partitioned into two halves by a transversal isolating plate, and such isolating plate passes through the hollow sections for inserting the protruded member into an embedded groove such that the blade holder presses against an end of the connector to form an insert member corresponsive to the blocking groove of the connector, and an accommodating groove has an embedded member corresponsive to the embedded hole of the insert rod;

such arrangement enables the connector and the blade holder to be embedded or removed quickly and easily in order to facilitate the disassembly for cleaning and reduce the volume for storage and transportation as well as lower the transportation cost.

* * * * *